United States Patent [19]

Schwaab et al.

[11] 4,335,666

[45] Jun. 22, 1982

[54] STRIP SEVERING MECHANISM FOR SEWING MACHINES

[75] Inventors: Konstantin H. Schwaab, Aichwald-Lobenrot; W. Andreas Petzold, Überlingen; Werner A. Glöckle, Besigheim, all of Fed. Rep. of Germany

[73] Assignee: Union Special G.m.b.H., Stuttgart, Fed. Rep. of Germany

[21] Appl. No.: 180,715

[22] Filed: Aug. 25, 1980

[30] Foreign Application Priority Data

Sep. 1, 1979 [DE] Fed. Rep. of Germany ..... 2935405

[51] Int. Cl.[3] ..... D05B 37/04

[52] U.S. Cl. ..... 112/130

[58] Field of Search ..... 112/130, 288, 291, 293, 112/294, 278, 272

[56] References Cited

U.S. PATENT DOCUMENTS

| | | | |
|---|---|---|---|
| 1,387,012 | 8/1921 | Ringe | 112/130 |
| 1,958,132 | 5/1934 | Davis | 112/130 X |
| 2,376,417 | 5/1945 | Chudner | 112/294 X |
| 2,483,138 | 9/1949 | Helmer | 112/130 X |
| 2,685,664 | 8/1954 | Visconti | 112/130 X |
| 2,881,833 | 4/1959 | Hoffee | 112/130 |
| 3,330,236 | 7/1967 | Des Ormeaux et al. | 112/294 X |
| 3,401,655 | 9/1968 | Johnson et al. | 112/294 |
| 3,420,199 | 1/1969 | Miller et al. | 112/293 X |
| 3,468,269 | 9/1969 | Des Ormeaux et al. | 112/294 X |
| 3,587,499 | 6/1971 | Mundter | 112/288 |
| 3,599,568 | 8/1971 | Newman | 112/278 |
| 3,682,029 | 8/1972 | Hass et al. | 83/69 |
| 3,848,554 | 11/1974 | Kropf | 112/130 X |
| 3,848,555 | 11/1974 | Boser | 112/288 |

*Primary Examiner*—H. Hampton Hunter

*Attorney, Agent, or Firm*—John W. Harbst; John A. Schaerli

[57] ABSTRACT

A sewing machine having a scissor-like cutting device for severing a continuous strip of tape or the like immediately subsequent to its exit from beneath the presser foot assembly of the machine. The operation of the cutting device is influenced by a control system which includes a fiber optic light source for detecting the passage of work through the sewing area of the machine.

8 Claims, 5 Drawing Figures

STRIP SEVERING MECHANISM FOR SEWING MACHINES

FIELD OF THE INVENTION

This invention relates to sewing machines and more particularly to a trimming apparatus adapted to cut a continuous strip of material such as tape, lace or the like after it has been secured to a workpiece.

BACKGROUND OF THE INVENTION

In some sewing operations, it is desirable to secure lace, tape or the like to a workpiece edge. In such an operation, the tape or lace is usually drawn from a continuous roll and thereafter progressively fed in a superimposed relationship with the workpiece to and through the machine's sewing station. Upon sewing tape or lace to the workpiece, it becomes necessary to sever the sewn on tape between successive workpiece or garments. Also, in most operations, it is imperative to sever the tape substantially co-extensive with the workpiece edge to which it is sewn.

It is well known to provide a sewing machine with a tape cutter for accomplishing this general purpose. Exemplary of such machines is the apparatus disclosed in U.S. Pat. No. 1,958,132 to H. L. Davis and granted May 8, 1934. The disadvantage with this type of cutting device, however, is that the cutting device is positioned an extended distance beyond the stitch forming instrumentality. Thus, there may be a length of tape which extends from the workpieces subsequent to the tape being cut. This excess tape is waste and requires subsequent, costly operations to produce an acceptable garment. Some of these machines have been known to employ mechanical sensors for detecting the workpiece. Mechanical sensor arrangements, however, have been known to be particularly sensitive and/or delicate and are susceptible to malfunctioning thus resulting in possible faulty operation of the cutting apparatus.

In contrast to mechanical sensors, it is known to use optical like sensor arrangements for detecting the workpiece. Exemplary of such devices is the arrangement shown in U.S. Pat. No. 2,881,833 to J. M. Hoffee granted Apr. 14, 1959. Such optical sensors, however, also have drawbacks. That is, optical sensors are usually sensitive to light dispersion and differing material density. Further, many optical sensors or scanners are sensitive to ambient light. Such susceptibility may result in the faulty operation of the tape severing apparatus. Furthermore, the environment in which this type of apparatus finds utility is usually laden with dust and lint, both of which may also effect the efficiency of such sensors. Furthermore, a photocell arrangement is usually not employed in close proximity to the sewing area because of the vibratory characteristics of the machine operation.

German Pat. No. 2,209,238 granted to Triumph International A.G. reveals an attempt at solving the problem of locating a tape cutter in close proximity to the sewing instrumentalities. This patent discloses a tape cutting apparatus which employs a blade and anvil for severing the tape. With this apparatus, however, an increased cutting force is required to sever the tape because of the single acting blade. Because of only one blade and to assure severance of the tape, a longer time is required to cut through the tape. Because of its proximity to the stitch forming instrumentalities, the longer cutting period effects the uniform work flow and, hence, the quality of the stitches being produced. Thus, there is a distinct advantage in extending the cutting period when the cutting apparatus is disposed in close proximity to the stitch forming instrumentalities.

SUMMARY OF THE INVENTION

In view of the above, and in accordance with the present invention, there is provided a strip cutting apparatus which is designed to overcome all of the aforementioned drawbacks. These have been essentially solved by providing a scissor-like tape cutting apparatus arranged in the limited space requirements of the stitch forming area. That is, the present invention provides a tape cutting apparatus that is mounted closely proximate the stitch forming area of the machine and which is provided with a unique sensing means and control apparatus for regulating the sewing and tape cutting functions of the machine.

The present invention includes a cutting device having a stationary blade arranged beneath the sewing plane and a movable blade adapted for cooperation therewith. Arranging the fixed blade beneath the sewing plane allows the cutting device to be situated between the presser foot assembly and the longitudinal axis of the presser bar. The movable blade is normally held out of contact with the fixed blade and above the advancing tape. By this arrangement, the tape may be severed from the workpiece immediately subsequent to its exit from beneath the presser foot sole. Suitable knife driving means mays be operatively connected to the movable blade through a toggle linkage assembly. As is apparent, the toggle linkage yields the advantage that the upper blade has the greater tape cutting velocity, thus assuring greater tape cutting reliability.

Photoelectric sensor means including an optical light guide may be used for detecting the workpiece in the sewing area. In the presently preferred embodiment, a fiber optic light source is used as the sensing means. The fiber optic light source employed with the present invention is insensitive to the vibratory characterisitics of the sewing area and is not adversely affected by ambient light. One end of the fiber optic light source may be positioned in close proximity to the workpiece path and opposite a light reflecting surface. The other end of the fiber optic light source is connected to a control device. In this manner, dispersion or distortion of the light is eliminated. The control apparatus is effectively interposed between the sensing means and the knife actuating means for timely controlling the tape cutting cycle of the apparatus. Further, the control apparatus of the present invention may regulate the operation of the machine to ensure proper and accurate severance of the tape.

It is therefore a primary object of this invention to provide a strip cutting apparatus which operates on a scissor like principle and which is effective and efficient in its operation.

It is another object of this invention to provide an improved strip severing apparatus which effectively separates the strip from the workpiece immediately subsequent to the exiting of same from beneath the presser foot assembly.

Another object of this invention is the provision of a strip cutting apparatus which includes a unique photoelectric sensing means for detecting the workpiece as it advances through the sewing station.

BRIEF DESCRIPTION OF THE DRAWINGS

Having in mind these and other attendant advantages that would be evident from an understanding of this disclosure, the invention comprises the devices, combinations, and arrangements of parts as illustrated in the presently preferred embodiment of the invention which is hereinafter set forth in detail so as to enable those skilled in the art to readily understand the functions, operation, construction and advantages of it when read in conjunction with the accompanying drawings in which.

DETAILED DESCRIPTION OF THE PRESENT INVENTION

Figure 3:
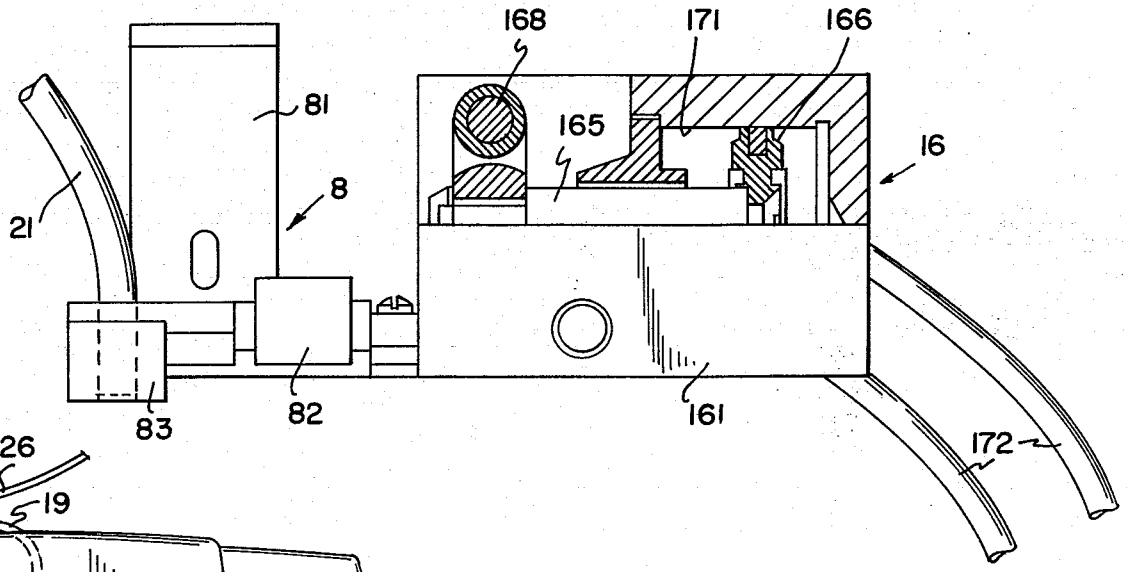
FIG. 3 is a front elevational view, partly in section, taken along Line 3—3 of FIG. 2.
Figure 1:
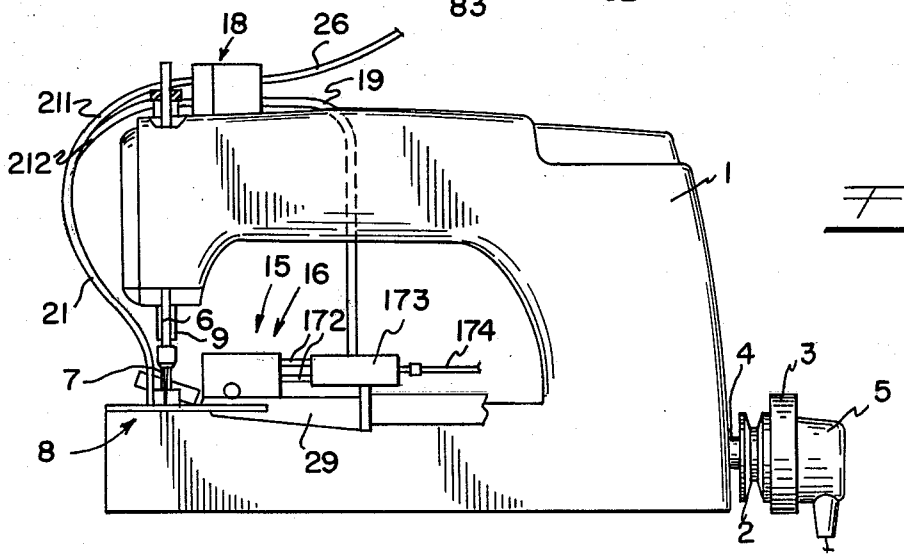
FIG. 1 is a front elevational view of one variety of industrial sewing machine fitted with the present invention.

Referring to the drawings wherein like reference numerals indicate like parts throughout the several views, there is shown an industrial sewing machine 1. Journaled for rotation within the frame of the machine is a main shaft 4, provided at its rearward end with the usual handwheel 3 and drive pulley 2. The machine mainshaft 4 is operatively connected at its other end to a conventional needle bar 6 which is adapted for endwise reciprocation within the machine frame. The needle bar 6 carries at its lower end needle means 7 adapted to cooperate with lower stitch forming instrumentalities for securing a continuous tape or the like to a workpiece. Also arranged for vertical endwise reciprocation within the frame of the machine is a presser bar 9 which carries at its distal end a presser foot assembly 8. During the machine's operation, the work is advanced over the throat plate 11 and past the sewing station by a series of feed dogs 131, 132, and 133 which are projected through the usual feed dog slots 121, 122, and 123 arranged in the throat plate 11.

Motion may be imparted to the feed dogs through any suitable feed mechanism means connected thereto and actuated to effect a lower four-motion type feed. The throat plate is further apertured as at 111 so as to allow the needles 7 to reciprocally pass through the work and throat plate. A stitch tongue 112 on the throat plate allows overlap stitches to be formed. Movement may be imparted to the elements of the machine by a positioning motor which is connected to a pulse generator or reader 5, the latter producing a pulse for every revolution of the main shaft 4. The above elements are operated in a conventional manner by the sewing machine to perform the usual stitching operations upon a continuous strip and successive workpieces and will be understood by those skilled in the art so it is not deemed necessary to expand the disclosure in relation thereto.

The presser foot assembly 8 includes an offset shank 81 that operatively secures the presser foot sole members 82 and 83 to the presser bar 9. The sole members, 82, 83, may be displaced in height in order to compensate for the various material heights that are to be sewn. The presser foot soles 82, 83 and the shank 81 are formed so as to provide a free space under the presser bar 9. It is into this free space that the tape cutting apparatus 15 of the present invention is accomodated.

Figure 2:
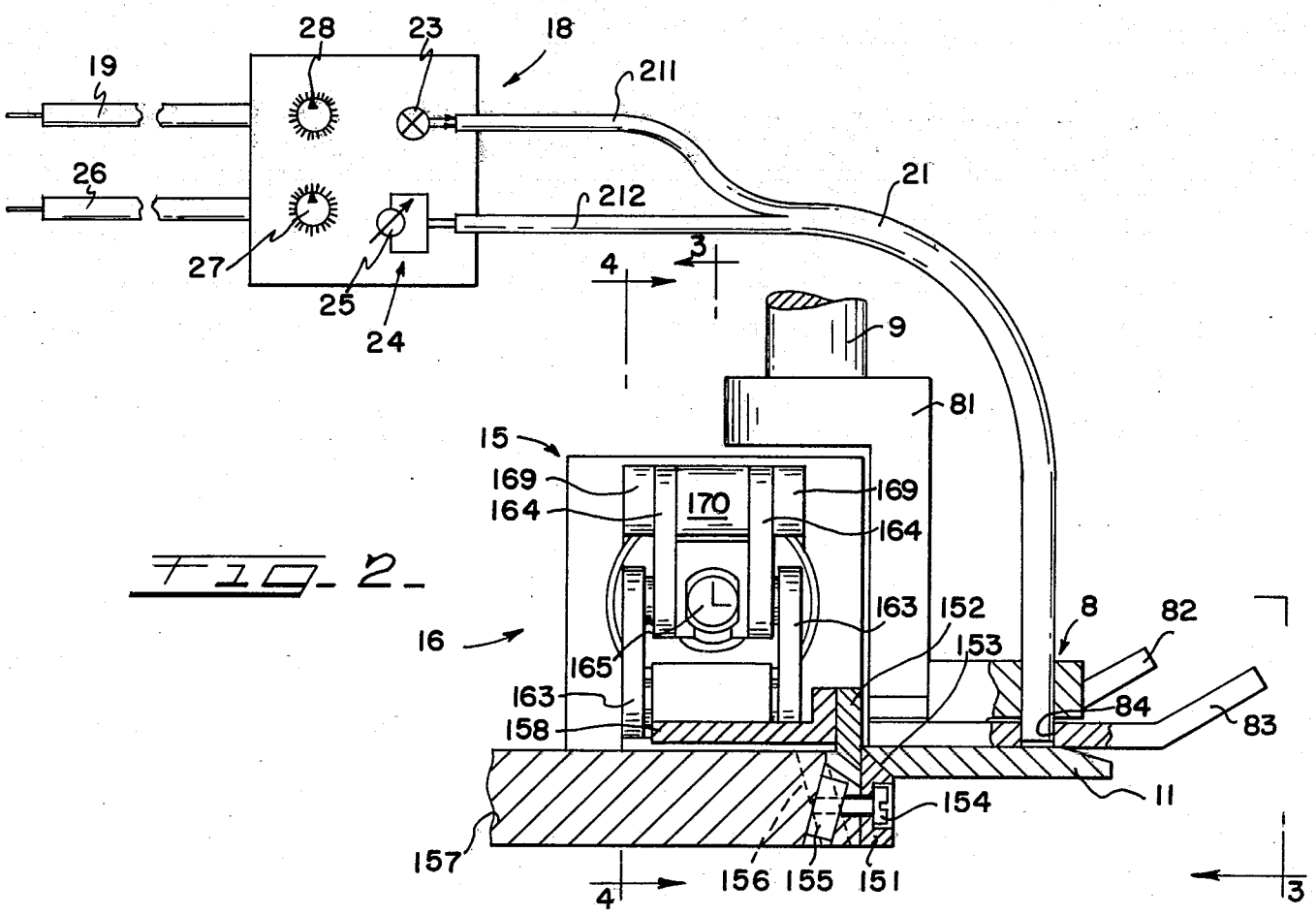
FIG. 2 is a schematic side view representation, partly in section, illustrating the present invention.
Figure 4:
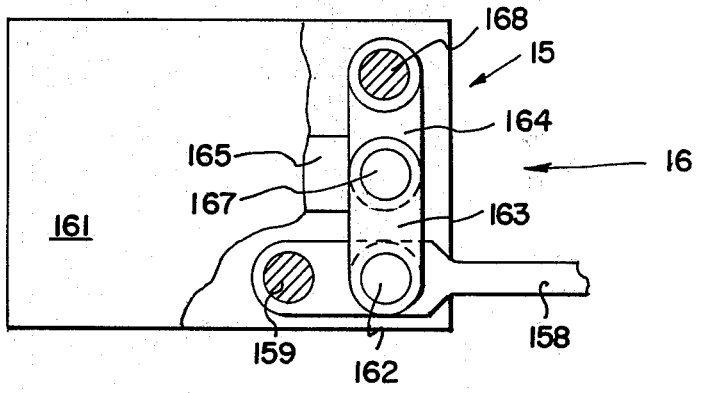
FIG. 4 is a rear elevational view, partly in section, taken along Line 4—4 of FIG. 2.
Figure 5:
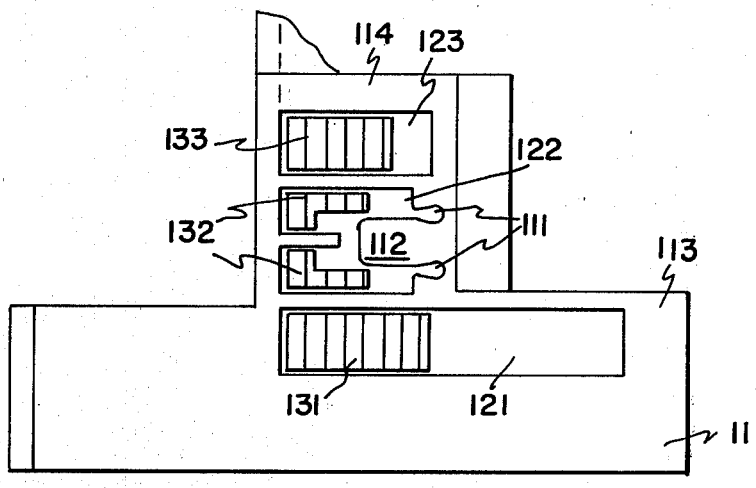
FIG. 5 is a top plan view illustrating the sewing area of the machine.

The tape cutting device of the present invention includes a stationary blade 151, a movably mounted second blade 152, and a knife driving assembly 16. As best seen in FIG. 2, the fixed blade 151, over which the workpiece and tape travel, is operatively secured to the work support 157 immediately adjacent the terminal end of presser foot sole 83 underneath the presser bar by means of screws 154 or the like. The upper edge 153 of the blade 151 is inclined downwardly and engages a corresponding surface on the terminal end of the throat plate 11 so as to fixedly support same in the frame of the machine. In the preferred embodiment, the aforesaid fasteners are threadably engaged with blade holder means 155 that may be secured in inclined apertures 156 provided in the work support surface 157. As will be appreciated, the arrangement of the blade holders 155 permits the blade 151 to brace the throat plate 11 even under severe loading. Furthermore, this mounting arrangement provides for adjustment of the cutting edge of the blade 151 relative to the throat plate 11 to compensate for sharpening and regrinding of same.

In the preferred embodiment, the movable blade 152 is secured to the free end of a lever or operating arm 158. The opposite end of arm 158 is articulated about a pivot 159. A driving mechanism 16, housed within a casing 161, is employed to move or drive the arm 158 and the blade 152 carried thereby from its retracted position to its cutting position. That is, during the sewing operation the movable blade 152 is normally held out of contact with the first blade and above the advancing tape. A spaced pair of toggle links 163 and 164 are connected, respectively, to arm 158 and housing 161, the arm and housing being provided with suitable pin connections 162 and 168 for this purpose. As best seen in FIG. 2, suitable spacers 169 and 170 hold the linkage assembly in proper position during operation of the cutting device. The driving means for moving the toggle arms includes a piston 166 which is slidably arranged within a cylinder 171 formed in the casing 161. The operative end 165 of the piston 166 is connected to the toggle links by pin 167 which serves to hold the arms 163 and 164 together. The driver 16 has air supply lines 172 which communicate through suitable passageways with the cylinder 171. The means for controlling movement of the piston 166 includes suitable valve means 173 arranged intermediate a compressed air source (not shown) and the supply lines 172. It will be appreciated, however, that other suitable driving means, i.e. electric or fluidic, would suffice for the intended purpose.

The operation of the valve member 173 is influenced by a control means, generally designated 18, the last two mentioned elements being connected over line 19. The control means is provided with sensor means 21 which is in the form of a fiber optic light guide. The distal end of the light guide is arranged on one side of the workpiece path opposite a light reflecting surface. Preferably, the distal end of the light guide is housed or mounted within the presser foot sole and terminates in close proximity to the workpiece path of travel. The opposite end of the optic fiber 21 is divided into a plurality of leads or branches identified 211 and 212. One lead 211 is associated with a light source 23 while the other lead 212 is associated with a photosensitive semiconductor 24 including adjustable potentiometer means 25. The light source 23 is adapted to emit a beam of light which is transmitted, without dispersion by the fiber optic tube to the sewing area of the machine. Accordingly, reflected beams of light are similarly returned to the controlled device through branch 212 and, hence, upon the photosensitive semiconductor 24. For purposes described hereinafter, the control device 18 further includes a series of stitch counters 27 and 28 that may be selectively regulated by the operator to predetermine positions. Lead 26 connects the control device with the positioning motor.

In operation, a continuous strip of tape or the like is presented to the sewing area through a suitable guide apparatus 29. Thereafter, the workpiece and tape are progressively fed through the machine by the feed dogs 131, 132 and 133. The operation of the machine may be controlled either by the operator or automatically by the control device. At the instant the workpiece interrupts the light path defined by the space or path between the fiber optic light source and the reflective surface, the photosensitive means 24 is triggered and one of the stitch counters is energized. As a result of the photosensitive means detection, the control means 18 regulates the speed of the machine. Thereafter, the machine operates at a predetermined speed and the motor continues to receive pulses arriving from the reader 5 until the preset count in the energized stitch counter expires. The preset count in the counter normally corresponds to the space interval between the sensing means and the cutting device divided by the stitch length. That is, the stitch count acts as a predetermined delay between the detection of the work and the actuation of the knife assembly. Once the preset count expires, the knife drive means is energized. As a result, blade 152 moves in its cutting stroke almost instantaneously to sever the tape substantially at the leading edge of the workpiece. The machine continues to run at a speed determined by the operator or automatically at a predetermined speed. Following the severance of the tape's leading edge, the workpiece blocks the sensor means light path. Therefore, while the work is progressively moved through the sewing station no cutting action will occur. The instant that the trailing edge of the work passes beyond the sensor means light path, the other counter is energized. Following expiration of the preselected count in the second counter, the knife means is again timely energized and another cut takes place, whereby severing the tape substantially co-extensive with the trailing edge of the workpiece. Of course, if desired, any preselected length of tape may extend from either end of the workpiece simply through the operator's selection of the stitch count.

Thus, there has been provided a strip severing mechanism for sewing machines which meets the object, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. Apparatus for trimming tapes and the like and adapted for use on a sewing machine having stitch-forming means for attaching the tape to a workpiece both of which are progressively moved through the machine, a throat plate, vertically movable presser bar means and a presser foot assembly including a shank adapted to operatively secure a presser foot sole to the presser bar, said trimming apparatus comprising:

stationary blade means arranged beneath the presser bar means and over which the workpiece and tape travel;

second blade means adapted for cooperation with the stationary blade and normally held out of contact therewith above the advancing tape;

means for actuating the second blade means to cause it to sever the binding from the workpiece along a line extending substantially coextensive with the workpiece edge; and means for controlling the actuating means, said control means includes a fiber optic light source one end of which is mounted in said presser foot sole opposite a reflecting surface on said throat plate, the other end of said fiber optic light source is connected to a control device including means responsive to a workpiece passing between a light path defined by the path between the first end of the fiber optic light source and the reflective surface and adapted to timely energize said actuating means whereby moving the second blade means into a cutting relationship with said tape.

2. The invention according to claim 1 wherein said stationary blade means serves to support one end of said throat plate.

3. The invention according to claim 2 further including means for regulating the position of said stationary blade relative to said throat plate and the blade holder.

4. The invention according to claim 1 wherein said actuating means and said second blade means are operatively connected through a toggle like linkage assembly.

5. In combination with a sewing machine having means for moving a workpiece and a continuous strip through the machine's sewing station defined by the needle means adapted to secure the strip to the workpiece, a vertically arranged presser bar with a presser foot assembly having a shank for operatively securing a presser foot sole to the presser bar and an apparatus for cutting the continuous strip between successive workpieces comprising:

knife means arranged underneath the presser bar immediately adjacent the terminal end of said presser foot sole with respect to the direction of feed of the workpiece being sewn;

means operative to move the knife means into a severing relationship with said strip; and means for controlling said means operative said control means including a fiber optic light source arranged on one side of the workpiece path, a reflective surface arranged opposite the end of said fiber optic light source, said fiber optic light source being connected at its opposite end to a control device responsive to the receipt of light from said fiber optic light source in the absence of a workpiece passing between the end of said light source and said reflective surface for controlling the actuation of said operative means and thereby the severance of the strip between successive workpieces.

6. Apparatus for trimming tapes and the like and adapted for use with a sewing machine having means for advancing the tape and a workpiece past a stitching mechanism, a throat plate, a vertically arranged presser bar with a presser foot assembly including a presser foot sole secured to the depending end thereof, said trimming apparatus comprising:

a tape cutting device arranged intermediate the terminal end of said presser foot sole and the longitudinal axis of said presser bar;

means for actuating the cutting device so as to cut said tape; and means for controlling the actuating means, said control means including a fiber optic light source one end of which is fixedly arranged in said presser foot sole in advance of the cutting device and opposite a reflecting surface on said throat plate, the other end of said fiber optic light source serves as an input to a control device that responds to a tape passing between the light path defined by the space between the first end of said fiber optic light source and the reflective surface for controlling the movements of the tape cutting device in relation to the tape.

7. Apparatus for trimming a tape or the like from an article as the article is progressively advanced with the tape through a sewing station whereat they are secured together, said machine includes a throat plate and a vertically arranged presser bar with a presser foot assembly having an offset shank for operatively securing a presser foot sole to the presser bar, said trimming apparatus comprises:

a pair of cooperating knife means arranged beneath the presser bar in the offset area of said presser foot shank for severing the tape from the workpiece immediately subsequent to the workpiece exiting from beneath the presser foot sole means;

knife drive mechanism means;

sensing means including an optical light guide arranged on one side of the path of the article passing through the machine and in front of said presser bar;

a reflective surface arranged opposite the light guide; and control means operatively associated with said sensing means and said knife drive mechanism means for providing a predetermined delay between the sensing of a workpiece and the actuation of said knives whereby providing selective control of the length of tape extending from the workpiece.

8. Tape trimming apparatus adapted for use with a machine having means for securing a continuous strip of tape to a workpiece both of which are progressively advanced through the machine, presser bar means and a presser foot assembly including a presser foot sole operatively secured to the free end of said presser bar, said trimming apparatus comprises:

first blade means arranged beneath the presser bar means immediately adjacent the terminal end of said presser foot sole;

second blade means adapted to cooperate with said first blade means in a scissor-like action;

means for actuating the second blade means to cause it to sever the tape;

photoelectric sensor means including an optical light guide having one end arranged on one side of the path over which the workpiece travels;

a reflective surface arranged opposite the optical light guide; and control means connected to the opposite end of said sensing means for controlling the timely energization of said actuating means in response to interruption of light received by the control means caused by the passage of a workpiece between the reflective surface and the sensing means.

* * * * *